United States Patent [19]

Owen

[11] 4,032,432

[45] June 28, 1977

[54] CONVERSIONS OF HYDROCARBONS

[75] Inventor: Hartley Owen, Belle Mead, N.J.

[73] Assignee: Mobil Oil Corporation, New York, N.Y.

[22] Filed: Aug. 28, 1975

[21] Appl. No.: 608,595

[52] U.S. Cl. ..... 208/70; 208/67; 208/71

[51] Int. Cl.[2] ..... C10G 37/06

[58] Field of Search ..... 208/67, 70, 71

[56] References Cited

UNITED STATES PATENTS

| | | | |
|---|---|---|---|
| 3,847,793 | 11/1974 | Schwartz et al. | 208/70 |
| 3,856,659 | 12/1974 | Owen | 208/71 |
| 3,891,540 | 6/1975 | Demmel et al. | 208/70 |
| 3,894,931 | 7/1975 | Nace et al. | 208/74 |
| 3,894,933 | 7/1975 | Owen et al. | 208/74 |
| 3,894,934 | 7/1975 | Owen et al. | 208/71 |
| 3,907,663 | 9/1975 | Owen | 208/70 |

*Primary Examiner*—Delbert E. Gantz
*Assistant Examiner*—James W. Hellwege
*Attorney, Agent, or Firm*—Charles A. Huggett; Carl D. Farnsworth

[57] ABSTRACT

A combination operation is described comprising gas oil cracking in the presence of a large and smaller pore size crystalline zeolite dual component cracking catalyst in which combination $C_6$ minus products are separated and catalytically upgraded under selected conditions providing cyclization and/or carbon chain growth as by oligmerization and polymerization. Conversion of $C_6$ and lower boiling hydrocarbons is particularly accomplished with the smaller pore crystalline zeolite of the dual component catalyst.

5 Claims, 1 Drawing Figure

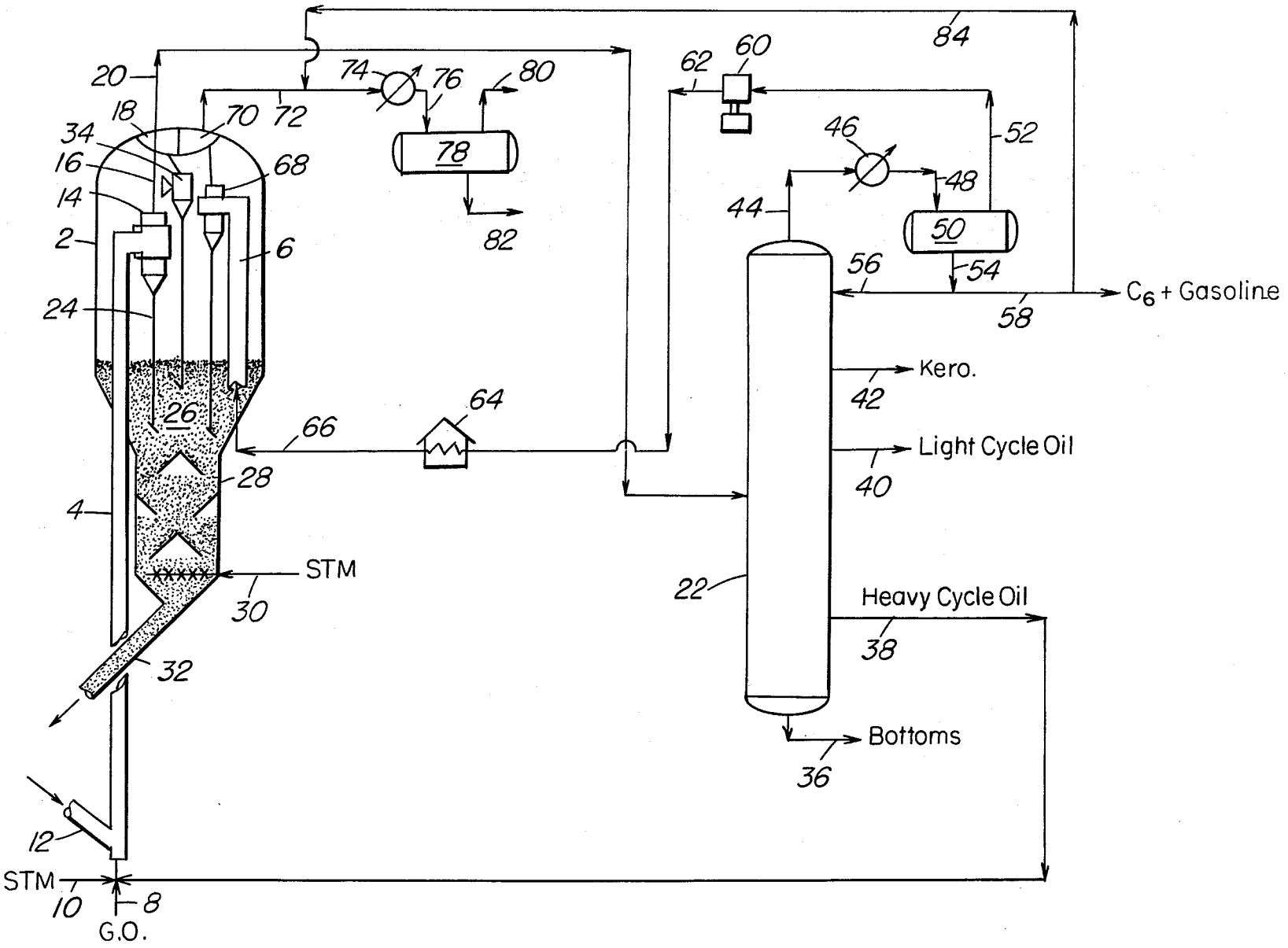
C6 + Gasoline
Kero.
Light Cycle Oil
Heavy Cycle Oil
Bottoms
STM
STM
G.O.

CONVERSIONS OF HYDROCARBONS

BACKGROUND OF THE INVENTION

The technology of catalytic cracking employing crystalline zeolite conversion catalyst has been the subject of continuous investigation since the development of the cystalline zeolite cracking catalyst. As new zeolites are developed and their properties studies, changes in processing technology are recognized and pursued with a view to reducing the overall economics of the refining operation. The present invention is related to an improvement of this kind and is particularly directed to reducing the size of the refinery light ends recovery operation by processing light end products of fluid cracking over relatively specific small pore zeolite catalyst which particularly promote the formation of olefin oligomers and polymers as well as cyclization of olefins to form aromatics.

SUMMARY OF THE INVENTION

The present invention is concerned with the conversion of hydrocarbon in the presence of a heterogenous catalyst mix comprising a relatively large pore crystalline material such as provided by a faujasite type of crystalline zeolites in combination with a smaller pore crystalline zeolite such as provided by a mordinite crystalline zeolites, an erionite crystalline zeolite or a class of zeolites represented by ZSM-5 crystalline zeolites and including ZSM-11, ZSM-12, ZSM-35 and ZSM-38 crystalline zeolites. In one aspect the present invention is concerned with more completely utilizing the activity and selectivity characteristics of a heterogenous catalyst mix comprising large and smaller pore size crystalline zeolites to upgrade crude oil component fractions and comprising hydrocarbon feed materials such as atmospheric and vacuum gas oils, $C_6$ and lower boiling hydrocarbons and particularly gasiform products obtained from such catalytic upgrading operation. In a more particular aspect, the present invention is concerned with upgrading a gasiform product of catalytic cracking recovered from the wet gas separator of a catalytic cracking operation and particularly comprising $C_6$ and lower boiling hydrocarbons by further contact thereof with a portion of the duel component crystalline zeolite cracking catalyst under conditions promoting the desired upgrading thereof. In a more particular aspect, the invention is concerned with using the heterogenous catalyst mix to particularly upgrade gasiform products of cracking by reaction mechanism involving olefin oligmerization, polymerization and/or olefin cyclization to form aromatics and/or alkyl aromatics. The gasiform material thus processed need not be limited to products of gas oil cracking but may also include straight run gasiform products of crude oil fractionation, the product of a high temperature hydrocracking operation or other available refinery sources, such as from coking, visbreaking or other olefin producing sources. In a particular embodiment, the present invention relates to upgrading a $C_6$ minus hydrocarbon product fraction such as obtained by gas oil cracking by further contacting this gasiform product fraction at a space velocity within the range of about 0.25 to about 13 V/V Hr. with catalyst separated from the gas oil cracking and maintained at a temperature within the range of 550° F to 900° F. Thus, the present invention contemplates the placement of a second riser reactor conversion zone adjacent to a gas oil cracking operation maintained under the same or different pressure conditions so that catalyst and gasiform product separated from the gas oil cracking operation may be cascaded substantially directly to the inlet of the second riser reactor. A substantially complete or partial stripping of the catalyst particles may be accomplished before cascaded to the second reaction zone. In this combination, the second riser may be confined within a catalyst collection vessel about the upper end of the gas oil riser cracking zone and generally above a downwardly extending open end stripping zone or vessel through which catalyst passes before passing to a catalyst regeneration operation. On the other hand, the second riser reactor may be partially on the outside and partially on the inside of the catalyst collection vessel similarly to the gas oil riser and provided with means for conveying catalyst separated from gas oil cracking before or after stripping thereof to the bottom inlet of the second riser conversion zone. In yet another embodiment, it is contemplated employing the second riser reactor as a separate reactor system wherein freshly regenerated catalyst adjusted to a suitable temperature below about 900° F. is employed either alone or mixed with cascaded gas oil cracking catalyst to accomplish the reactions desired. A dense fluid bed of catalyst may be employed in lieu of the second riser conversion zone. The $C_6$ minus gasiform fraction may be compressed or recycled without compression to a reduced pressure second reaction zone. It may be heated by hot catalyst combined therewith, or by a reheat furnace or a combination thereof as shown in the drawing.

In a particular aspect, the present invention is concerned with the crystalline zeolite cracking of high boiling portion of crude oil such as atmospheric and/or vacuum gas oils, residual oils and hydrogenated products thereof including a hydrogenated feed such as a hydrogenated residual oil. Cracking of the high boiling feed is desirably accomplished in the presence of a large pore, crystalline zeolite component such as a rare earth exchanged faujasite crystalline zeolite under elevated temperature cracking conditions selected from within the range of 900° F to about 1100° or 1200° F more usually at least about 1000° F, at a pressure within the range of atmospheric pressure up to about 200 psig more usually less than 75 psig and at a hydrocarbon residence time in a once through conversion operation within the range of 1 to about 15 seconds and more usually less than 10 seconds. Catalyst to oil ratios may be selected from within the range of 4 to about 30. Generally, it is preferred to accomplish cracking of the higher boiling material such as gas oil in an upflow riser conversion zone discharging into a combination of cyclone separation zones or into an enlarged catalyst separation zone containing cyclonic separating means wherein gasifrom products of cracking and catalyst are separated by changes in velocity causing catalyst separation by settling and centrifugal means. Thereafter, the hydrocarbon vapors separated from catalyst is passed to fractionation means. Thereafter, the hydrocarbon vapors separated from catalyst is passed to fractionation means. The riser conversion zones herein contemplated may discharge directly into cyclonic separating means attached to the riser discharge. Catalyst particles separated from the gasiform products of cracking are collected as a fluid bed of catalyst particles communicating with a cayalyst stripping zone wherein the catalyst of gas oil cracking is stripped of entrained products as by counter current contact with a hot stripping gas such as steam. The stripped products of reaction and stripping gas are recovered with the hydrocarbon products of the gas oil cracking operation after passing through suitable catalyst separating means such as cyclonic separating means.

As mentioned above, a second separate conversion zone such as a riser reactor is provided and located with respect to the gas oil cracking operation to permit cascade of the heterogenous catalyst mixture from the gas oil cracking step to the to the second gasiform conversion reacted to particularly affect a desired conversion and restructuring of $C_6$ minus materials recovered from the product of the gas oil cracking operation. A second riser reactor may be located completely within or partially external to the enlarged separating vessel about the upper end of the gas oil riser conversion zone. In this arrangement, the catalyst separated from the gas oil conversion operation and at an elevated temperature of at least about 800° F is available for use in the second reactor for processing $C_6$ minus hydrocarbons as herein described. In a particular aspect of this invention, a gasiform stream comprising $C_6$ and lower boiling hydrocarbons obtained from the product of gas oil cracking or other available sources as herein provided is admixed with the heterogenous catalyst mixture comprising large and smaller pore crystalline zeolite separated from the gas oil cracking step to form a second suspension at a temperature within the range of 500° to 900° F. The catalyst to gasiform feed ratio in the second suspension may be within the range of 5 to 40. To assist with varying the catalyst to hydrocarbon feed ratio, steam or other suitable inert gaseous diluent may be employed with the $C_6$ minus hydrocarbon stream. The diluent may be used to assist with affecting the lift characteristics of the suspension passed through the second conversion zone. In such an operation, the suspension is passed upwardly through the riser conversion zone under conditions providing a hydrocarbon residence time within the range of 1 to 10 seconds before being discharged therefrom and separated in provided cyclonic means. During this operation and particular when employing a ZSM5 class of crystalline zeolite hydrogen transfer activity, oligmerizing activity and olefins cyclization activity effectively converts the hydrocarbons comprising the $C_6$ minus hydrocarbon fraction to aromatics, alkyl aromatics and/or gaseous olefins, oligmers, or polymers.

It is contemplated in one embodiment of this invention of passing catalyst separated from the gas oil riser conversion zone to a separate zone wherein the catalyst is maintained in a relatively dense fluid bed condition during contact thereof with the $C_6$ minus products of gas oil cracking. In any of these arrangements, the operating conditions are selected to particularly promote the oligmerizing and/or cyclization reactions desired. It is also contemplated providing separate stripping zones for catalyst separated from each reaction zone before further use thereof as herein provided. In some circumstances, it may be desirable to include some freshly regenerated catalyst with the catalyst undergoing stripping and before effecting further use thereof an in the conversion of $C_6$ minus hydrocarbon or catalyst regeneration. In any of these arrangement, it is desirable to cascade the heterogenous catalyst mixture from the gas oil conversion zone effected at a temperature generally above about 1000° F to the $C_6$ minus gasiform conversion zone and to maintain the conditions employed therein to particularly promote the reactions herein described.

The drawing is a diagrammatic sketch in elevation of our arrangement for practicing the present invention comprising gas oil riser cracking, recovery of a $C_6$ minus gasiform product of gas oil cracking and upgrading the gasiform product in a separate reaction zone.

Referring now to the drawing, there is provided a vessel 2, a first riser reaction zone 4 and a second riser reaction zone 6. A gas oil feed boiling in the range of from about 600° F up to about 1000° F is introduced by conduit 8 to the bottom of riser 4. Steam or other suitable gasiform material may be introduced by conduit 10 as a diluent to conduit 8 for admixture with and dispersion of the gas oil feed coming in contact with hot freshly regenerated catalyst introduced by conduit 12. In the lower portions of riser 4, a suspension of catalyst and hydrocarbon feed, with or without diluent material is formed at a temperature in excess of about 900° F and more usually at least about 1000° F for passage upwardly through the riser under desired cracking conditions to suspension separation means such as cyclonic separating means 14. In cyclonic separating means 14, a separation is made between the catalyst and hydrocarbon products of the riser cracking operation. Separated gasiform hydrocarbon products are passed by conduit 16 to a separate plenum chamber 18 and thence by conduit 20 to a product fractionator 22 sometimes referred to as a syntower. Catalyst separated incyclonic means 14 withdrawn by dipleg 24 and passed to a relatively dense generally downwardly moving fluid bed of catalyst 26 collected and maintained in a lower portion of vessel 2. Fluid bed 26 is in communication with the open upper end of a stripping section by comprising the lower bottom portion of vessel 2. Stripping steam is introduced to the lower portion of the stripping section by conduit 30. Stripped catalyst is removed from the bottom portion of stripper 28 by conduit 32 and transferred to a regeneration zone not shown to removed deposited carbonaeous material of cracking by burning thereby heating the catalyst to an elevated temperature above 1000° F and up to as high as about 1400° F or 1600° F. Stripped products separated from the catalyst comprising bed 26 pass through cyclonic separator 34 and thence into plenum 18.

The gasiform products of gas oil cracking passed to fractionation zone 22 are separated therein into a bottoms or clarified slurry oil fraction removed by conduit 36, a heavy cycle oil fraction normally recycled to extinction and withdrawn by conduit 38, a light cycle oil fraction removed by conduit 36, a heavy cycle oil fraction normally recycled to extinction and withdrawn by conduit 40, a kerosine fraction withdrawn by conduit 42 and an over head fraction comprising gasoline and lower boiling material withdrawn by conduit 44. The overhead fraction withdrawn by conduit 44 is cooled in cooler 46 to a temperature of about 100° F before passing by conduit 48 to a wet gas separator drum or knockout drum 50. In separator drum 50, a light gasiform stream comprising predominately $C_6$ and lower boiling hydrocarbons along with other gaseous materials of the cracking operation are withdrawn by conduit 52 for conversion to desired products as more fully explained below. The composition of this stream 52 is provided in table 1 below.

TABLE 1

| $C_6$ Minus Stream From Light Ends Separator | |
|---|---|
| M-SCFD | 53707.54 |
| M-LBS/HR | 242.34 |
| MOL. WT. | 41.15 |
| PRESS. PSIA | 29.00 |
| TEMP. ° F. | 100.0 |
| MOLS/HR | |
| $H_2$ in Naptha | 550.60 |
| $CO_2$ | 45.80 |
| $N_2$ | 427.60 |
| $H_2O$ | 331.60 |
| Methane | 578.50 |
| Ethene | 193.90 |
| Ethane | 317.00 |
| Propene | 827.00 |
| Propane | 311.80 |
| Trans-2 Butene | 623.10 |
| Iso Butane | 456.00 |
| N-Butane | 114.20 |
| N-Pentanes | 620.60 |
| 155 NBP | 182.80 |
| 205 NBP | 79.00 |
| 255 NBP | 26.20 |
| 305 NBP | 6.50 |
| 355 NBP | 1.90 |
| 403 NBP | 0.30 |
| Water | 194.50 |

A gasoline condensate is recovered from separator drum 50 by conduit 54. A portion of the gasoline condensate thus recovered is recycled to the upper portion of fractionator 22 as reflux by conduit 56 with the remaining portion thereof recovered as product by conduit 58.

Gasiform material comprising predominately $C_6$ and lower boiling hydrocarbons of the cracking operation, identified in table 1 above, and at a pressure of about 25 psig are compressed in compressor 60 to a pressure of about 40 psig or higher depending on the pressure selected for the combined operation. The compressed $C_6$ minus hydrocarbon fraction is then passed by conduit 62 to a furnace 64 wherein preheating thereof is accomplished to the extent required so that when mixed with catalyst particles recovered at an elevated cracking temperature a suspension is formed providing a catalyst - hydrocarbon mixture at a desired temperature select from within the range of 500° to about 900° F. It is also contemplated operating the second riser 6 at a reduced pressure from that used in the gas oil cracking operation so that the $C_6$ minus material may be cascaded without using compressor 60. In the specific arrangement of the drawing, the $C_6$ and lower boiling hydrocarbon product in conduit 62 pass through a furnace 64 and then by conduit 66 to the inlet of riser reactor 6 wherein it is admixed with catalyst withdrawn from catalyst bed 26 to form a suspension. The, thus, formed suspension is passed through the riser under the conditions herein specified. The suspension passing through riser 6 is discharged into cyclonic separator 68 wherein a separation is made between the suspended catalyst and gasiform products of reaction. The separated gasiform products comprising one or more of olefin oligmers, aromatics and/or alkyl aromatic depending upon reaction conditions employed are passed to plenum chamber 70 which is separated from chamber 18 by a suitable baffle means. The products of riser conversion zone 6 passed to plenum 70 is then passed by conduit 72 to a heat exchange train represented by cooler 74 wherein its temperature is reduced to about 100° F. The cooled product is then passed by conduit 76 to separator drum 78. In separator drum 78, uncondensed gasiform material is separated from liquid product and withdrawn by conduit 80 for passage to a light ends recovery operation not shown.

The composition of this stream 80 is provided in table 2 below. Liquid product separated in drum 78 and identified in table 3 is withdrawn therefrom by conduit 82 for passage to a light ends recovery operation not shown.

TABLE 2

| SEPARATOR VAPOR | |
|---|---|
| M-SCFD | 37172.37 |
| M-LBS/HR | 151.45 |
| MOL. WT. | 37.16 |
| PRESS. PSIA | 29.00 |
| TEMP. ° F. | 100.00 |
| MOLS/HR | |
| $H_2$ in Naphtha | 550.42 |
| $CO_2$ | 45.51 |
| $N_2$ | 427.30 |
| $H_2O$ | 326.99 |
| Methane | 577.04 |
| Ethene | 132.83 |
| Ethane | 313.66 |
| Propene | 40.17 |
| Propane | 301.25 |
| Trans-2 Butene | 27.63 |
| Iso Butane | 418.85 |
| N-Butane | 101.87 |
| Pentanes | 445.77 |
| 155 NBP | 88.10 |
| 205 NBP | 109.61 |
| 255 NBP | 33.17 |
| 305 NBP | 0.26 |
| 355 NBP | 0.03 |
| 403 NBP | 0.00 |
| Water | 135.47 |

TABLE 3

| SEPARATOR LIQUID | |
|---|---|
| BPSD | 8628.02 |
| M-SCFD | 9888.57 |
| M-LBS/HR | 90.89 |
| MOL. WT. | 83.82 |
| PRESS. PSIA | 29.00 |
| TEMP. ° F. | 100.00 |
| MOLS/HR | |
| $N_2$ in Naphtha | 0.18 |
| $CO_2$ | 0.29 |
| $N_2$ | 0.30 |
| $H_2O$ | 4.61 |
| Methane | 1.46 |
| Ethene | 1.07 |
| Ethane | 3.34 |
| Propene | 1.23 |
| Propane | 10.55 |
| Trans-2 Butene | 3.57 |
| Iso Butane | 37.15 |
| N-Butane | 12.33 |
| N-Pentane | 174.83 |
| 155 NBP | 114.70 |
| 205 NBP | 362.19 |
| 255 NBP | 289.03 |
| 305 NBP | 6.24 |
| 355 NBP | 1.87 |
| 403 NBP | 0.30 |
| Water | 59.03 |

In the combination operation of this invention, it is contemplated using liquid product in conduit 58 or low pressure distillates as a lean oil and passing a portion thereof by conduit 84 for admixture with the gasiform material in conduit 72 before cooling and separation thereof by cooler 74 and separator drum 78. On the other hand, this lean oil material in conduit 84 may be admixed with cooled product in conduit 76 before passing to separator drum 78.

The combination operation of this invention offers considerable improvements over known processing arrangements by improving or upgrading the $C_6$ minus product of gas oil cracking in addition to considerably reducing the requirements of a normal light ends recovery plant by as much as about 30 precent. It will be observed from a review of the data comprising the above tables that a considerable amount of propane and trans-2 butene was converted. In addition the yield of material having a 205 and 255 normal boiling point (NBP) was considerably increased.

Having thus generally described the invention and provided a specific example in support thereof, it is to be understood that no undue restrictions are to be imposed by reason thereof except as defined by the following claims.

I claim:

1. A method for converting hydrocarbons in the presence of a heterogenous catalyst mix comprising a relatively large pore faujasite crystalline zeolite mixed with a smaller pore crystalline zeolite selected from the group consisting of erionite and mordenite crystalline zeolites which comprises, passing a relarively high boiling hydrocarbon feed of at least gas oil boiling range in admixture with said heterogenous catalyst mix upwardly through a first hydrocarbon conversion zone at an elevated cracking temperature within the range of 900° to 1200° F and a hydrocarbon residence time in the reaction zone up to 15 seconds but sufficient to form hydrocarbon conversion products thereof, separating said catalyst mix from said hydrocarbon conversion products, separating said conversion products into a $C_6$ and lower boiling fraction, a gasoline fraction and a higher boiling fraction including heavy cycle oil, recovering the separated gasoline and higher boiling fractions, contacting the separated $C_6$ and lower boiling components with a portion of said heterogenous catalyst mix separated from hydrocarbon conversion products of said first conversion zone at a temperature within the range 550° to 900° F at a space velocity in the range of 0.25 to 13 promoting at least one of olefin oligmerization, polymerization and olefin cyclization, and separately recovering products of said $C_6$ and lower boiling products upgrading separately from said high boiling hydrocarbon conversion operation.

2. The methods of claim 1 wherein the high boiling feed is a residual oil and the $C_6$ minus product is a product of residual oil conversion which is converted in an adjacent upflowing catalyst conversion zone and catalyst separated from the products of the residual oil conversion is cascaded to the inlet of the adjacent upflowing catalyst conversion zone to upgrade the separated $C_6$ minus products.

3. The method of claim 1 wherein said heterogenous catalyst mixture is regenerated and employed in each of said conversion operations.

4. The method of claim 1 wherein a gasoline product of said gas oil conversion is mixed with upgraded products of the $C_6$ and lower boiling components conversion operation.

5. The method of claim 1 wherein the product of the high boiling feed conversion operation is separated to recover kerosene, light cycle oil and heavy cycle oil and the heavy cycle oil is recycled to the high boiling feed conversion operation.

* * * * *

UNITED STATES PATENT AND TRADEMARK OFFICE

CERTIFICATE OF CORRECTION

PATENT NO. : 4,032,432

DATED : June 28, 1977

INVENTOR(S) : HARTLEY OWEN

It is certified that error appears in the above-identified patent and that said Letters Patent are hereby corrected as shown below:

| | |
|---|---|
| Column 1, line 9 | "studies" should be -- studied --. |
| Column 1, line 50 | "mechanism" should be -- mechanisms --. |
| Column 3, line 63 | "an" should be -- as --. |
| Column 4, line 32 | before "withdrawn" add -- is --. |
| Column 4, line 36 | after section "by" should be -- 28 --. |
| Column 4, lines 53 & 54 | after "oil fraction" omit the words -- removed by conduit 36, a heavy cycle oil fraction normally recycled to extinction and --. |
| Column 7, line 17 | "relarively" should be -- relatively --. |
| Column 8, line 10 | "methods" should be -- method --. |

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*